United States Patent [19]

Muroya

[11] Patent Number: 4,669,406

[45] Date of Patent: Jun. 2, 1987

[54] APPARATUS AND METHOD FOR MANUFACTURING EMBROIDERED CARPETS

[75] Inventor: Takashi Muroya, Sakai, Japan

[73] Assignee: Sun Carpet Company, Ltd., Osaka, Japan

[21] Appl. No.: 890,639

[22] Filed: Jul. 30, 1986

[30] Foreign Application Priority Data

| | | | |
|---|---|---|---|
| Aug. 5, 1985 | [JP] | Japan | 60-172685 |
| Aug. 20, 1985 | [JP] | Japan | 60-183555 |
| Aug. 20, 1985 | [JP] | Japan | 60-183556 |
| Aug. 29, 1985 | [JP] | Japan | 60-191384 |
| Aug. 29, 1985 | [JP] | Japan | 60-132755 |

[51] Int. Cl.[4] ..... D05B 1/00

[52] U.S. Cl. ..... 112/262.1; 112/121.11; 112/151; 112/235

[58] Field of Search ..... 112/262.3, 121.11, 121.12, 112/121.15, 131, 235, 262.1

[56] References Cited

U.S. PATENT DOCUMENTS

| | | | |
|---|---|---|---|
| 3,450,076 | 6/1969 | Bender | 112/121.12 X |
| 3,765,349 | 10/1973 | Gerber | 112/121.12 X |
| 4,582,006 | 4/1986 | Yamane | 112/121.12 |
| 4,602,578 | 7/1986 | Yokoe et al. | 112/121.12 |

FOREIGN PATENT DOCUMENTS

| | | | |
|---|---|---|---|
| 1300621 | 12/1972 | United Kingdom | 112/121.12 |

*Primary Examiner*—Ronald Feldbaum
*Attorney, Agent, or Firm*—Irvin A. Lavine

[57] ABSTRACT

The present invention provides an apparatus for manufacturing an embroidered carpet. This apparatus is such that pile yarn is dipped into a substrate cloth with a hook device to form a surface of the carpet which comprises means for driving said hook device along a memorized pattern so as to efficiently manufacture an embroidered carpet with a varigated design which has heretofore been manufactured only manually.

6 Claims, 23 Drawing Figures

APPARATUS AND METHOD FOR MANUFACTURING EMBROIDERED CARPETS

BACKGROUND OF THE INVENTION

1. Field of the Invention

The present invention relates in one aspect to an apparatus for manufacturing an embroidered carpet. In another aspect, the invention relates to a method for manufacturing an embroidered carpet. More particularly, the present invention relates to an apparatus for manufacturing an embroidered carpet of a type such that pile yarn is driven into a substrate cloth with a hook device to form a surface of the carpet which comprises means for driving said hook device along a memorized pattern so as to efficiently manufacture an embroidered carpet with a varigated design which has heretofore been manufactured only manually.

2. Description of the Prior Art

Embroidered carpets are generally classified into tufted carpets and hooked carpets or rugs. Compared with tufted carpets, hooked carpets are advantageous in that they can be made available in a variety of designs, although the productivity is lower.

The conventional hook machine a shown in FIGS. 18 and 19 comprises a movable hollow member b with a beveled end which is adapted to be inserted into a substrate or matrix cloth A, an inserting plate c disposed within said movable hollow member b and adapted to make a loop C of pile yarn B passed into said movable hollow member b, and, optionally, a scissor means d disposed in said movable hollow member b and adapted to cut said loop C of said pile yarn B. In this arrangement, the hook machine a is caused to travel only over the top side (the reverse side of the finished rug) of the substrate cloth A so as to make a weave pattern corresponding to the locus of travel of the hook machine. With this machine, even a carpet with a picturesque design can be manufactured by selecting the proper topographic drive schedule for the hook machine and the proper colors of pile yarn. However, there has been no system that may ensure an automatic drive of the hook device for the manufacture of carpets with varigated patterns. Thus, the operator holds the hook machine by hand and slides it on the substrate cloth to a predetermined pattern. In this manual system, there is a limitation on the traveling attitude of the hook machine, that is to say the hook device a must be driven along in such a manner that the beveled portion at tip of the movable hollow member b will face backward with respect to the direction of travel at all times. Accordingly, it is difficult to control the attitude of the hook device a in accordance with the locus of travel.

SUMMARY OF THE INVENTION

It is an object of the present invention to provide an apparatus and method for manufacturing an embroidered carpet which ensures an automatic travel of a hook device in response to the output of an NC unit and an automatic orientation of the attitude of the hook device according to its direction of travel so as to manufacture a carpet with a delicate graphic pattern.

It is another object of the present invention to provide an apparatus and method for manufacturing an embroidered carpet which comprises a travel platform disposed in a plane parallel to a weaving frame supporting a substrate cloth and adapted to travel over said substrate cloth, said travel platform being driven for each of a plurality of embroidering sections according to a preset program in such a manner that said hook device is lowered into abutment with said substrate cloth at the origin of said embroidering section and lifted away from the substrate cloth at the end of said embroidering section, with the pile yarn being cut at the end of each of said embroidering sections so as to manufacture a loop-weave embroidered carpet.

It is a further object of the present invention to provide an apparatus and method for manufacturing an embroidered carpet which is further provided with means for preventing the substrate cloth supported by the weaving frame from being displaced to a significant extent so as to minimize an offset between the locus of travel of the hook device and the embroidering line.

It is still another object of the present invention to provide an apparatus and method for manufacturing an embroidered carpet which is further provided with mechanical means for ensuring an automatic travel of the hook device in an X- and Y-axis plane parallel to the substrate cloth supported under tension by the weaving frame, rendering said hook device operative, and lowering said hook device toward said substrate cloth to bring a guide member into abutment with said substrate cloth, the downward load acting on said guide member being minimized so as to reduce the offset between the locus of travel of said hook device and the finished pattern.

It is yet another object of the present invention to provide an apparatus and method for manufacturing an embroidered carpet which is further characterized in that an abutment guide provided at the lower end of the body of said hook device for the purpose of maintaining a constant spacing between the hook device and the substrate cloth is free from a local projection that might engage the pile yarn protruding from the substrate cloth. Other objects and advantageous features of the present invention will become apparent from the detailed description which is given hereinater with reference to the accompanying drawings illustrating preferred embodiments and the recitation given in the appended claims.

DESCRIPTION OF THE PREFERRED EMBODIMENTS

The preferred embodiment of the apparatus according to the present invention will now be described with reference to the accompanying drawings.

The apparatus according to this embodiment generally comprises a weaving frame 1 for supporting a substrate cloth A under tension, a first travel platform 2 disposed in parallel with the X-axis of said weaving frame 1 and adapted to travel along the Y-axis thereof, a first travel unit for causing said first travel platform 2 to travel in the direction of Y-axis, a second travel unit and a second travel platform as disposed on said first travel platform 2, and an NC unit N for controlling the actions of said respective components.

Each of these components will now be described in detail.

Figure 3:
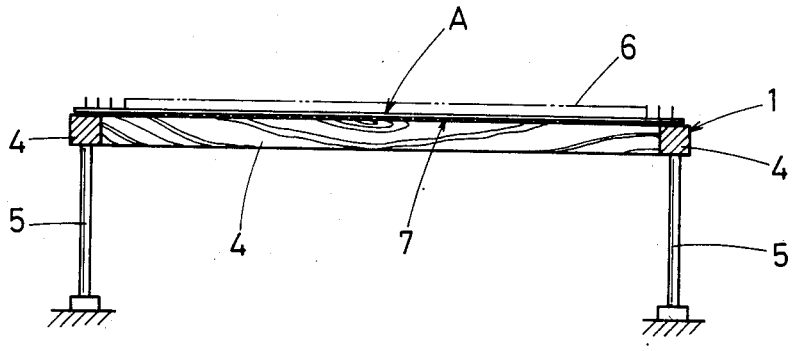
FIG. 3 is a sectional elevation view illustrating a weaving frame of the same apparatus.
Figure 4:
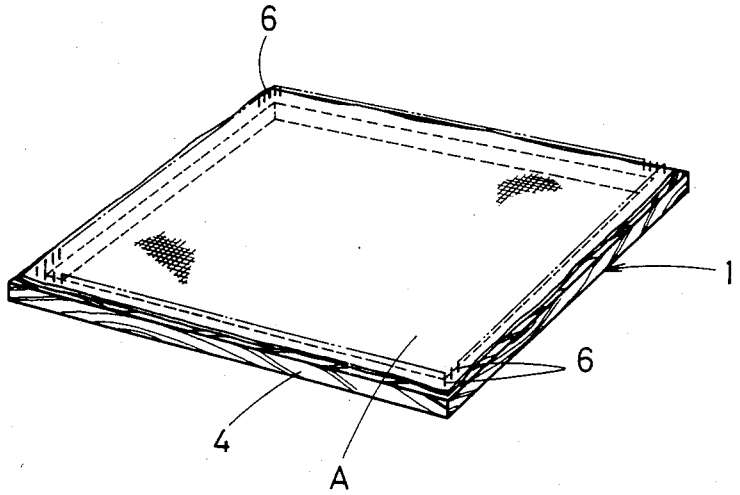
FIG. 4 is a perspective view illustrating a substrate cloth supported under tension by said weaving frame.

(1) The Weaving frame 1:

As illustrated in FIGS. 3 and 4, the weaving frame 1 comprises four horizontal bars 4 . . . arranged in a square configuration and four legs 5 . . . thereunder, and is disposed in a horizontal position. On the top surface of each horizontal bar 4, that is each side of the weaving frame 1, there is provided a row of retaining needles 6 . . . for engaging the substrate cloth A in position.

As the retaining needles 6 . . . arranged on the four sides of the weaving frame 1 are pierced through four sides of said substrate cloth A, the substrate cloth A is supported in tense condition on the frame as illustrated in FIGS. 3 and 4.

In the weaving frame 1 according to this embodiment, a coarse-mesh net 7 of supporting cords having high tensile strength is previously spread on the frame by utilizing the retaining needles 6 . . . .

Figure 5:
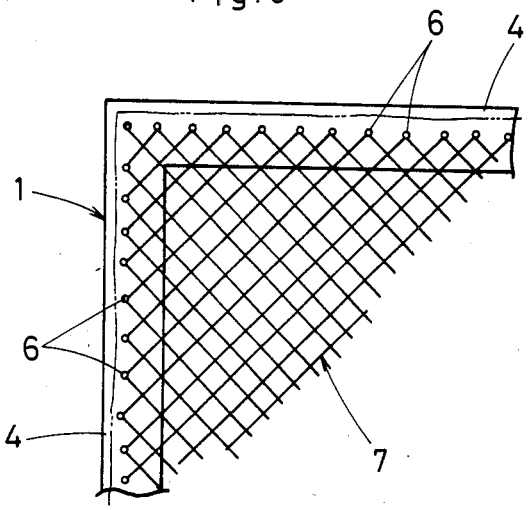
FIG. 5 is a plan view showing groups of supporting cords as disposed on said weaving frame.

Thus, as shown in FIG. 5, a net 7 such as a fishnet is used in this embodiment. Such a net 7 can be spread simply by engaging the retaining needles 6 . . . of the weaving frame 1 with the meshes near the edges of the net 7. Moreover, when this type of net is utilized, as the cords constituting the net 7 are linked at intersections, the substrate cloth is more effectively prevented from being displaced as compared with the other embodiments described hereinafter.

Figure 6:
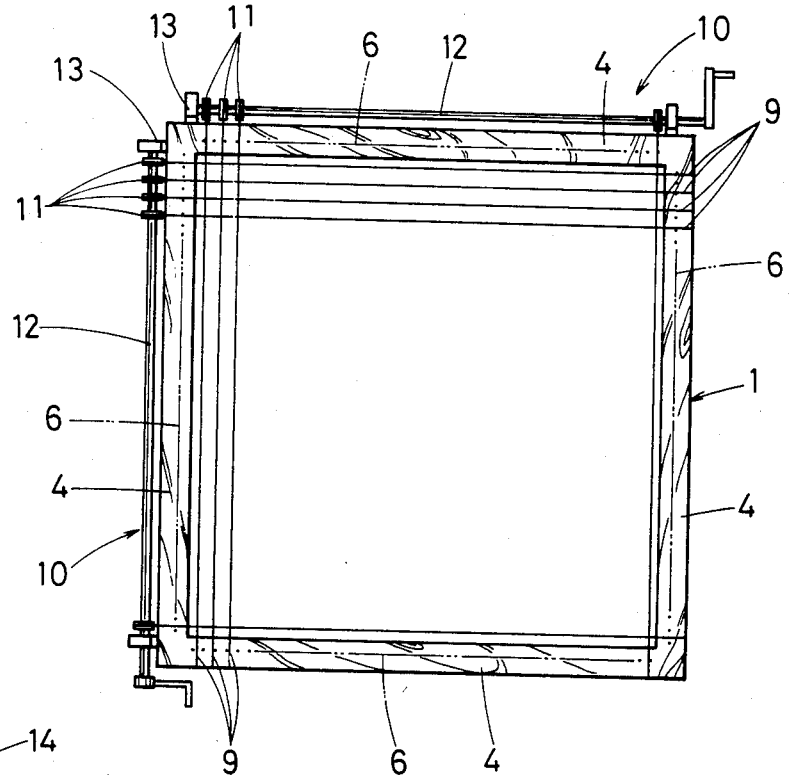
FIG. 6 is a plan view showing another set of groups of supporting cords as disposed on said weaving frame.

The arrangement of supporting cords shown in FIG. 6 is made up of individual cords 9 disposed at predetermined intervals over the whole area between the opposite sides of the weaving frame 1 and is spread by securing one end of each individual cord 9 to one side of the weaving frame and pulling the other end over a pulley 11 of a winching unit 10 located laterally of the opposite side.

In this particular embodiment, the group of supporting cords 9 . . . in the longitudinal direction are winched up at one time to set the cords 9 . . . in tense condition on the frame. In this connection, a one-way clutch mechanism is built into a journal means 13 supporting a shaft 12 of the winching unit 10.

If a similar one-way clutch mechanism is adopted between each pulley 11 and the shaft 12, the pulleys 11 . . . can be individually driven to vary the balance of tension of said supporting cords 9 . . . .

In the embodiment illustrated in FIG. 6, there is a further advantage that when one of the supporting cords 9 . . . is broken, it is sufficient to replace the particular cord only with a new one for restoring the supporting cord assembly.

Figure 7:
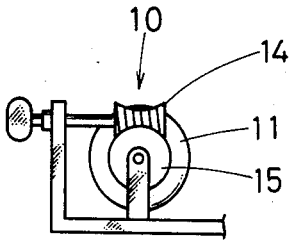
FIG. 7 is a side-elevation view showing an example of winching device for said weaving frame.

As said winching unit 10, a worm gear device as shown in FIG. 7, which is like a device for tightening guitar cords, may be disposed for each supporting cord. The reference numeral 14 represents a worm and the numeral 15 represents a worm gear.

Figure 8:
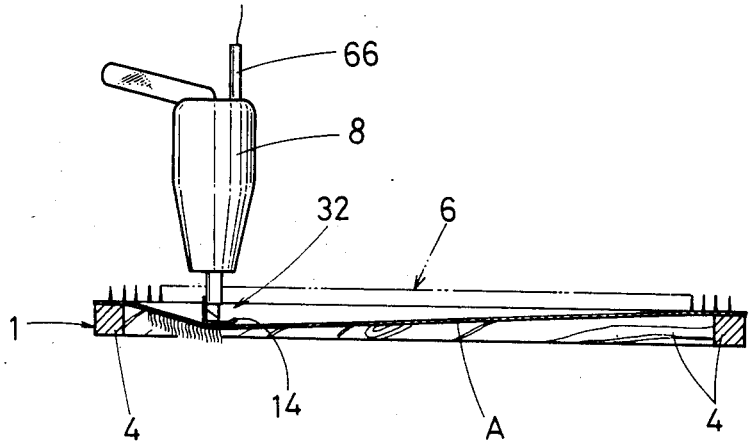
FIG. 8 is a schematic view illustrating the relation between the substrate cloth and the hook device.
Figure 9:
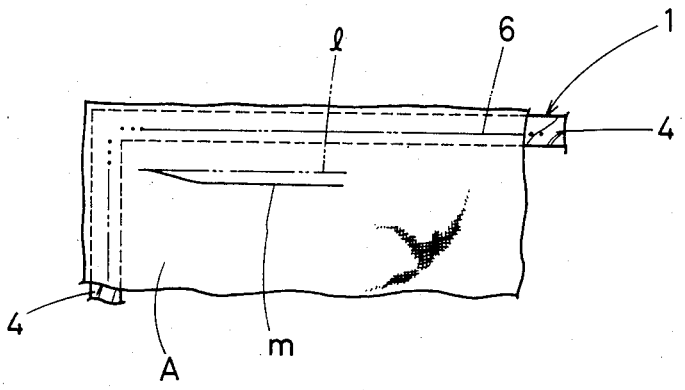
FIG. 9 is a schematic view illustrating a comparison between the locus of travel of the hook device and the actual embroidered pattern of pile yarn.

In any of the above embodiments, the supporting cords may be made of various materials including metals, plastics and so on, although materials having sufficiently high tensile strength are desirable. When a hook device 8 is driven over the substrate cloth A spread on the weaving frame carrying the above-described net 7 (see FIG. 8), the amount of deflection of the substrate cloth A due to the weight load of the hook device 8 is smaller than in the absence of such a net. Therefore, as will be apparent from FIG. 9, the offset in the locus of travel due to change in the above-mentioned amount of deflection is minimized. In other words, the amount of offset between the locus 1 of the hook device 8 traveling linearly along the weaving frame 1 near its corner and the locus m of the device on inner area of the substrate cloth A is minimized.

Figure 1:
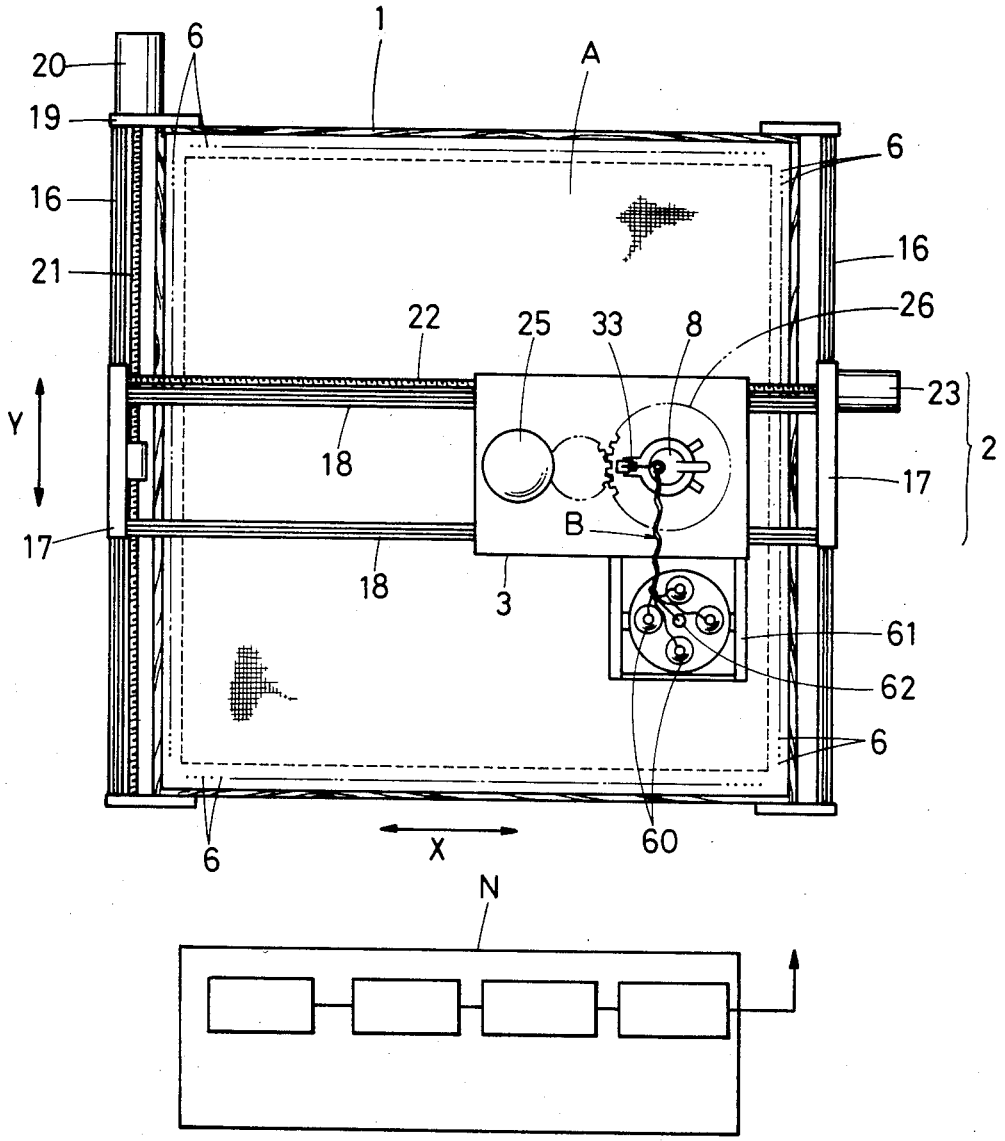
FIG. 1 is a plan view showing an embodiment of the embroidered carpet manufacturing apparatus according to the present invention.

(2) The first travel platform 2 and the first travel unit:

As illustrated in FIG. 1, the first travel platform 2 is mounted in parallel with a pair of first support rails 16, 16 disposed along the respective opposite sides paralleling the Y-axis. This first travel platform 2 comprises a pair of leg members 17, 17 disposed in parallel with each other and along said first support rails 16, 16 as shown and a pair of cross members 18, 18 interconnecting said leg members 17, 17.

Affixed to a bracket 19 of one of said first support rails 16, 16 is a first pulse motor 20 which serves as a first drive means, and a first feed screw 21 adapted to be driven in normal and reverse directions and engaging in threaded relation with one of said leg members 17 is disposed in parallel with said first support rail 16. Thus, said first pulse motor 20, first support rails 16, 16 and first feed screw 21, taken together, constitute a first travel unit which shifts the first travel platform 2 in a normal or reverse direction according to the output of said NC unit N.

(3) The second travel platform 3 and the second travel unit:

As shown in FIG. 1, the second travel platform 3 is mounted between the cross bars 18, 18 in movable relation therewith and adapted to travel along said cross bars 18, 18, i.e. in the direction of X-axis. Located below one edge of said second travel platform 3 is a rotatable second feed screw 22 in meshed relation therewith between said leg members 17, 17 of said first travel platform 2 and this second feed screw 22 is rotated by a second pulse motor 23 disposed on one of said leg members 17, 17.

In the above arrangement, said second travel platform 3 travels in a normal or reverse direction along X-axis according to the output of said second pulse motor 23. The aforesaid second pulse motor 23, second feed screw 22, second travel platform 3 and cross bars 18, 18, taken together, constitute a second travel unit.

Figure 2:
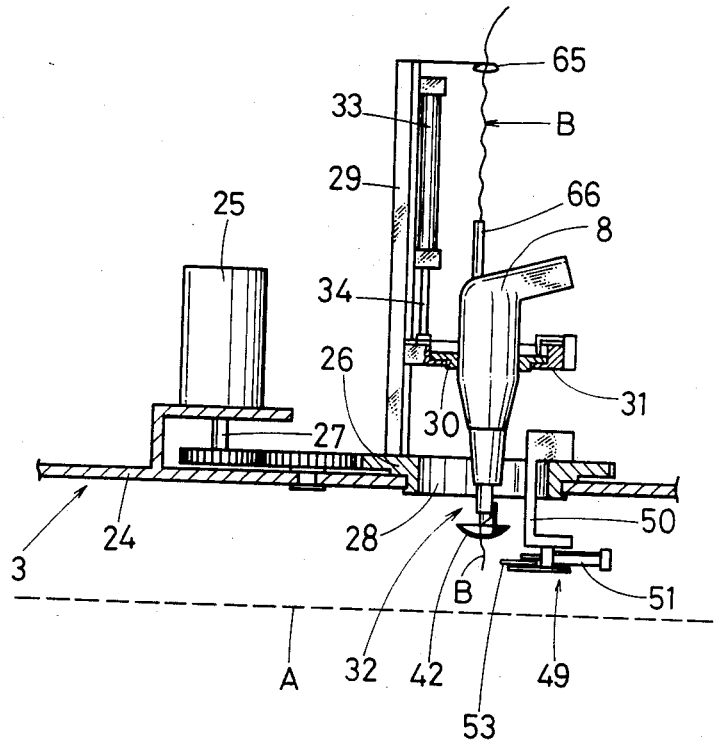
FIG. 2 is a cross-sectional view showing a second travel platform of the same apparatus.

Further, as shown in FIG. 2, the top plate 24 of said second travel platform 3 is provided on the upper surface thereof with a third pulse motor 25 as a third drive means and an annular gear 26 which serves as a rotary element, said gear 26 being engaged by an output shaft 27 of said third pulse motor 25 in a predetermined gear ratio for transmission of motor output.

The peripheral wall defining a central orifice 28 of said gear 26 is concentrically mounted around an orifice provided in said top plate 24 and a post 29 for supporting the hook device 8 is perpendicularly fixed to said gear 26.

The hook device 8 used in this embodiment is a conventional manual weaving hook device (for example, the TYPE-15 model manufactured by Uneyama Seisakusho), provided that it is fitted with a flange 30 in an intermediate position. This flange 30 is fitted into an annular frame 31 provided on said post 29 so as to control the mounting attitude of the hook device 8. In this arrangement, a needling mechanism 32 at the tip of the hook device 8 protrudes downward in the center of said gear 26.

The above-mentioned annular frame 31 is slidably associated with one end thereof by said post 29 and connected to an output shaft 34 of a first air cylinder 33 secured to said post 29 in a position close to the point of engagement 33.

Therefore, in this particular embodiment, the hook device 8 moves up and down in accordance with the action of said first air cylinder.

Particularly in this embodiment, the dead weight of the hook device 8 and the dead weight of the annular frame 31 adapted to mount the hook device on the post 29 act to depress the hook device in a downward direction (a downward load). However, as mentioned hereinbefore in (1), this depressing force must not be too large in order to reduce the deflection of substrate e cloth A to a minimum. Therefore, the above-mentioned first air cylinder 33 is operated in an output pattern reverse to the usual situation so as to reduce the downward moment of the hook device 8.

Figure 10:
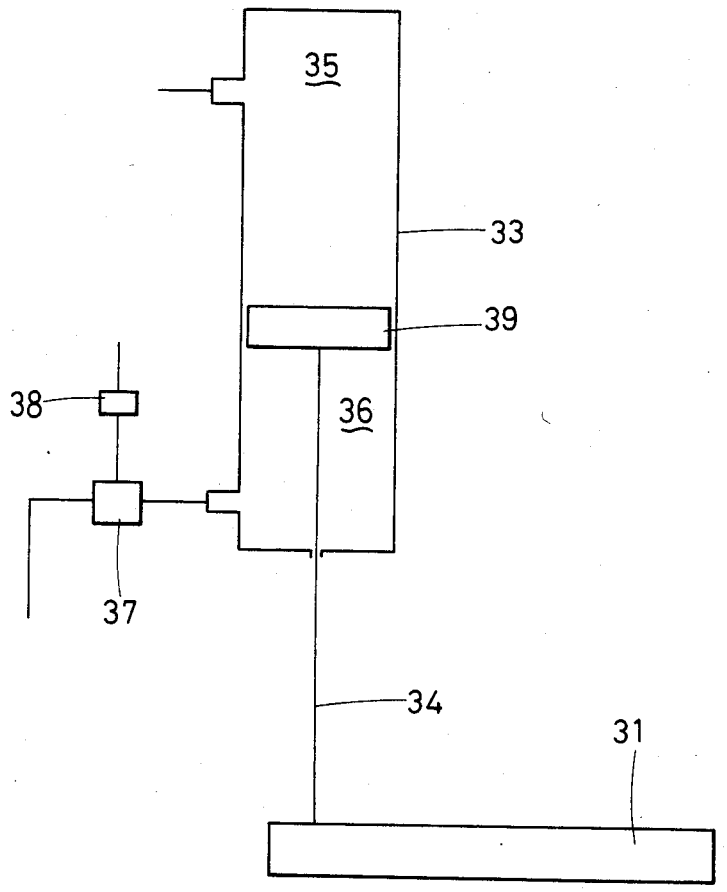
FIG. 10 is a schematic view illustrating an air circuit for a first air cylinder.

Thus, in response to the output signal from the NC unit N to be described hereinafter, the hook device 8 is lowered towards the substrate cloth A at a predetermined location. However, as the dead weight of the hook device and ancillary members is larger than the load corresponding to the proper depressing force, it is so preset that in response to a hook descend signal input to the first air cylinder 33, the air cylinder 33 is held in a non-output state and subjected to a predetermined upward pressure acting on a piston 39 therein, while the first air cylinder 33 is brought into an output state and the hook device 8 lifted in response to an upward reset signal. Furthermore, the lifting force acting on the output shaft 34 of the first air cylinder 33 in the non-output state of the cylinder 33 corresponds to the dead weight of the hook device and ancillary members subtracted by the proper depressing force. To ensure the above action, this embodiment employs the arrangement illustrated in FIG. 10. Thus, a space 35 on the farther side of the output shaft 34 of the first air cylinder 33 is released open and an air pressure is introduced into a space 36 on the same side as the output shaft 34 from a pressurized air source via a switch valve 37. And a discharge air pressure control valve 38 preset to a predetermined discharge pressure is interposed in a circuit on the discharge side of said switch valve 37.

In the above arrangement, when the air pressure is supplied to said space 36 from said switch valve 37, the output shaft 34 lifts the hook device 8. Conversely when the above switch valve 37 is switched to communicate said space 36 with the discharge circuit, the output shaft 34 descends as the pressure preset by said discharge pressure control valve 38 acts on the piston 39.

In this embodiment, therefore, the discharge circuit located on the discharge side of the first air cylinder 33 and the discharge pressure control valve 38 disposed in said circuit, in combination, discharge a biasing function as referred to hereinbefore.

Figure 11:
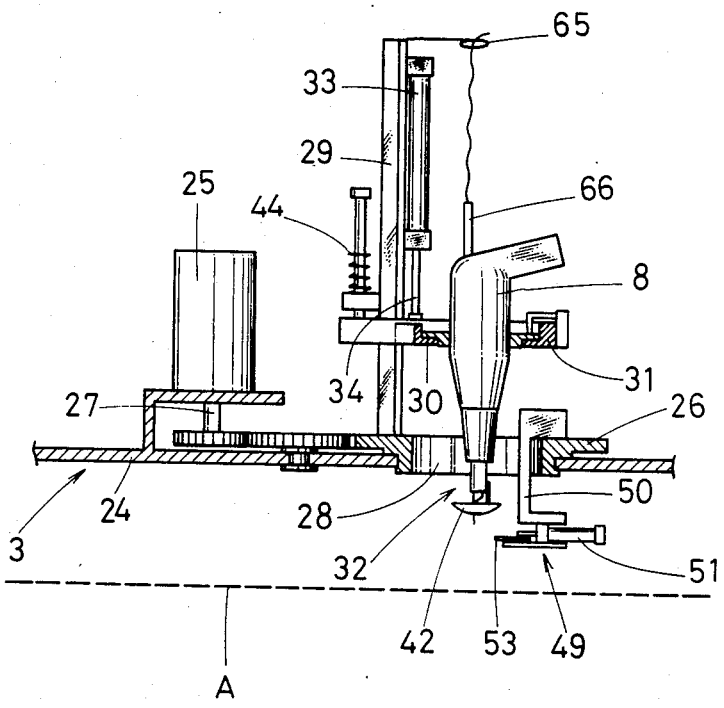
FIG. 11 is a schematic view illustrating another example of said second travel platform.

Referring to FIG. 11 which illustrates another embodiment, it is substantially identical with the embodiment described above in general aspects but a compression spring 44 for imparting an upward biasing force is interposed between a mounting base 31 and a post 29. Like the embodiment shown in FIG. 2, no lifting force is available on the output shaft 34 when the first air cylinder 33 is in non-output state but the hook device 8 and mounting base 31 descend together and the upward biasing force due to said compression spring 44 acts in the lowered state to discharge a function similar to that in the embodiment of FIG. 2.

Figure 12:
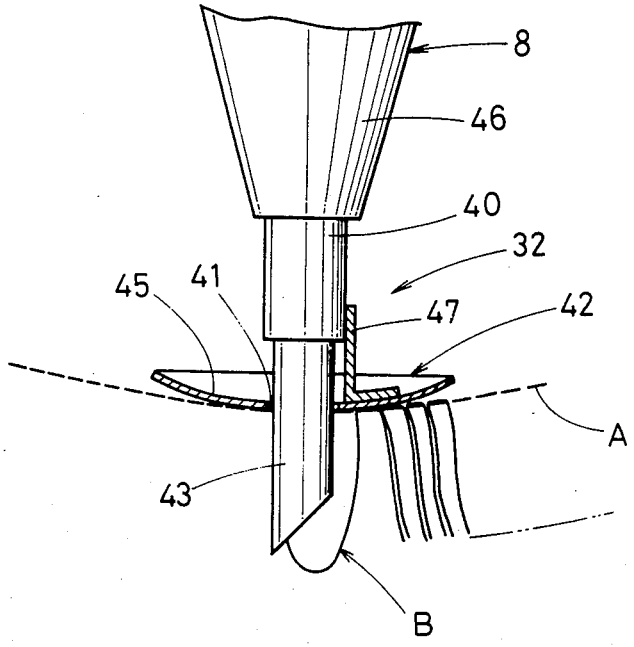
FIG. 12 is a side-elevation view showing a needling mechanism at the tip of the hook device in partial section.
Figure 18:
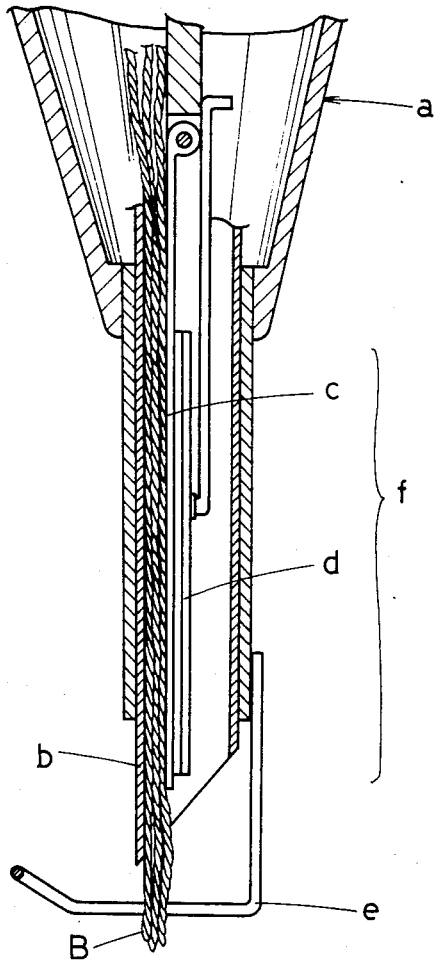
FIG. 18 is a simplified schematic view showing the conventional hook machine.
Figure 19A:
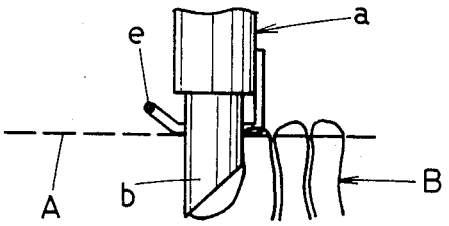
FIGS. 19(*a*), 19(*b*), 19(*c*), and 19(*d*) are schematic sequential views view showing the action of the same hook machine.
Figure 19B:
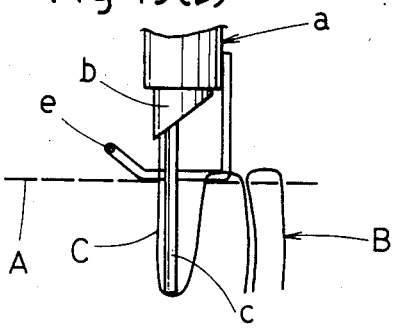
Figure 20:
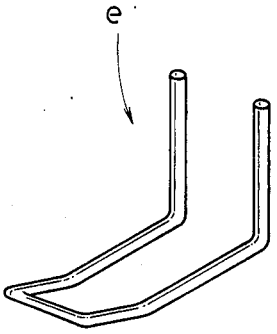
FIG. 20 is a perspective view showing an abutment guide of the same hook machine.
Figure 19C:
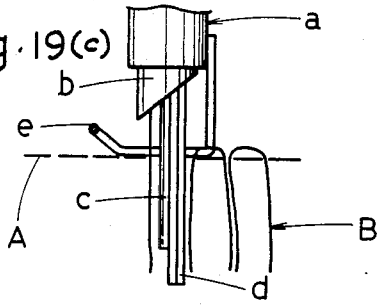
Figure 19D:
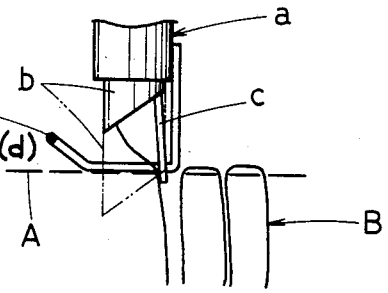

The needling mechanism 32 at the tip of the hook device 8 is somewhat different from the conventional needling mechanism f illustrated in FIG. 18. Thus, as shown in FIG. 12, a stopper (abutment guide) 42 which comes into contact with the substrate cloth A is uniquely designed. Thus, in this embodiment, the abutment guide 42 disposed in contiguity with a stationary cylinder 40 is formed as an arcuate dish-shaped member having a central perforation 41 in lieu of the conventional cord frame member e (see FIG. 20), with the movable hollow member 43 of hook device 8 moving up and down through said perforation 41. Thus, in the embodiment illustrated in FIG. 12, the cross-section of said abutment guide 42 consists of an arcuate portion with an extremely small radius of curvature forming a bottom 45 and an arcuate portion contiguous thereto and having a larger radius of curvature, and the perforation 41 formed in the center of said bottom 45 is dimensioned larger than the diameter of the movable cylinder 43. The stationary cylinder 40 disposed at the lower end of the body 46 of the hook device 8 is securedly linked to said abutment guide 42 by a connecting rod 47.

The above abutment guide 42 is advantageous in that when the hook device 8 changes its attitude in the lowered state, the whole peripheral region of said perforation 41 is in contact with substrate cloth A so that the guide 42 will not pick up the exposed portion of pile yarn B driven into the cloth in the immediately preceding operation cycle, thus permitting a smooth change in attitude of the hook device 8. Unlike manual weaving, if the conventional frame member e be employed in an automatic machine such as the apparatus according to the present invention, the frame member e would pick up the exposed part of pile yarn B as the hook device 8 changes its attitude.

In this embodiment, the abutment guide 42 is a dish-shaped element with a diameter of about 70 mm and a depth of about 15 mm. It was found that a guide of this size is fully useful.

The hook device employing the above abutment guide 42 is especially useful when as in the NC controlled carpet manufacturing apparatus of the present invention, the hook device 8 is driven in accordance with a programmed schedule of traveling direction and attitude to weave a predetermined pattern.

It should be understood that the above abutment guide 42 can be applied to a manual weaving device. In such an application, the abutment guide 42 is preferably made of a transparent material. In the case of manual weaving, the operator drives the hook device 8 along a pattern drawn on the substrate cloth. When the abutment guide 42 is a transparent element, the operator can see through the part of the pattern which lies ahead in the direction of travel.

Figure 13:
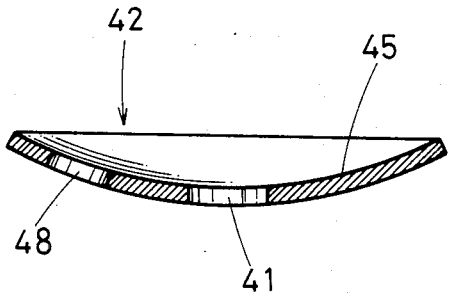
FIG. 13 is a longitudinal section view showing an example of abutment guide in said needling mechanism.

As an alternative, the abutment guide 42 may be made of an opaque material and provided with a local window 48 opening in the direction of travel as shown in FIG. 13.

In this embodiment of the present invention, a cutting unit 49 for cutting the pile yarn B is attached to the gear 26 via an arm 50, the length of which is so designed that a scissor portion 53 thereof comes into a position above and close to the substrate cloth A.

This cutting unit 49 is used when the pile yarn B is woven in the form of a loop by the hook device 8 and actuated at the time when the hook device 8 has completed its action for one section and risen back by a predetermined stroke.

Figure 14:
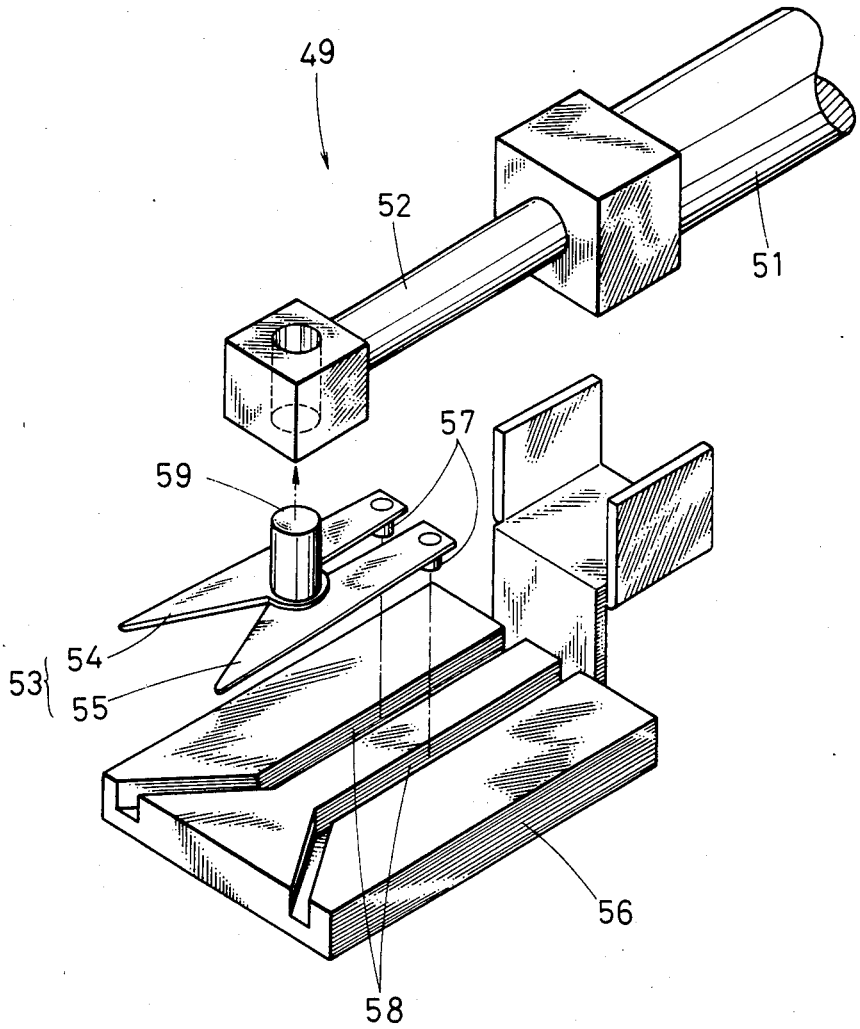
FIG. 14 is a perspective view illustrating a cutting unit as disassembled.

As shown in FIG. 14, the cutting unit 49 comprises said second air cylinder 51 responsive to the output signal from said NC unit N, said scissor unit 53 affixed to the output shaft 52 of said air cylinder 51, and a cam plate 56. The scissor unit 53 comprises a pair of blades 54, 55 and a fulcrum member 59 connected to the output shaft 52 of the second air cylinder 51. The blades 54, 55 have rearwardly extending projections 57, 57 which are respectively fitted into a pair of cam grooves 58, 58 formed in said cam plate 56.

These cam grooves 58, 58 are arranged substantially in the shape of letter Y in plan view with a gradually increasing spacing therebetween so that as the scissor unit 53 is advanced toward the forward end of the cam plate 56, the projections 57, 57 are displaced toward the forward end of cam grooves 58, 58. As a result, the spacing between the rear ends of blades 54, 55 is expanded to close the blades 54, 55 and thereby cut the pile yarn B pendant between the blades 54, 55.

Therefore, the amount of shift of the scissor unit 53 by the second air cylinder 51 and the position in which the scissor unit 53 performs cutting are set according to the reaction between the mounting position of the cam plate 56 having said cam grooves 58, 58 and the mounting position of the hook device 8.

The cam plate 56 is attached to the arm 50 along with the second air cylinder 51.

Figure 15:
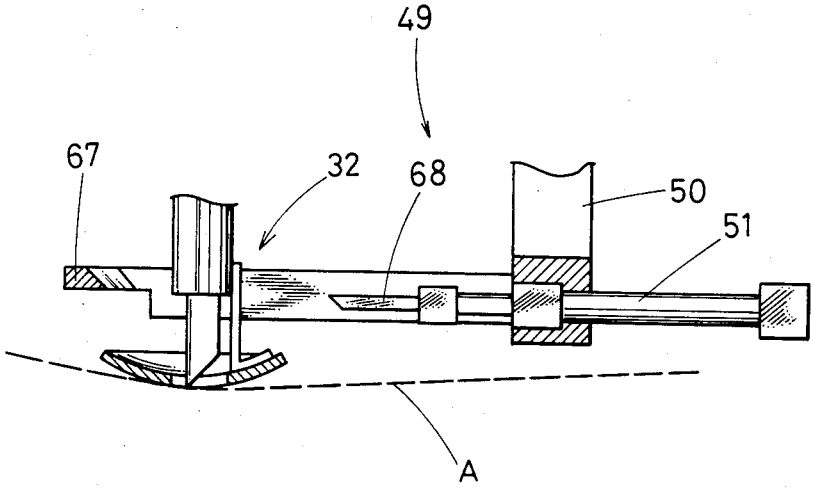
FIG. 15 is a side-elevation view showing another example of the cutting unit.

As said cutting unit, it is likewise possible to use, in lieu of the unit 49 described above, a combination, illustrated in FIG. 15, of a stationary blade 67 and a movable blade 68 which is driven to and from said stationary blade 67 by the second air cylinder 51.

In the above arrangement, said stationary blade 67 is located at all times in the vicinity of the needling mechanism 32 of the hook device 8 and at the time when the hook device 8 has risen back into a predetermined position, the second air cylinder 51 is actuated in response to an instruction from said NC unit N, whereby said moval blade 68 advances to cut the pile yarn B.

Figure 16:
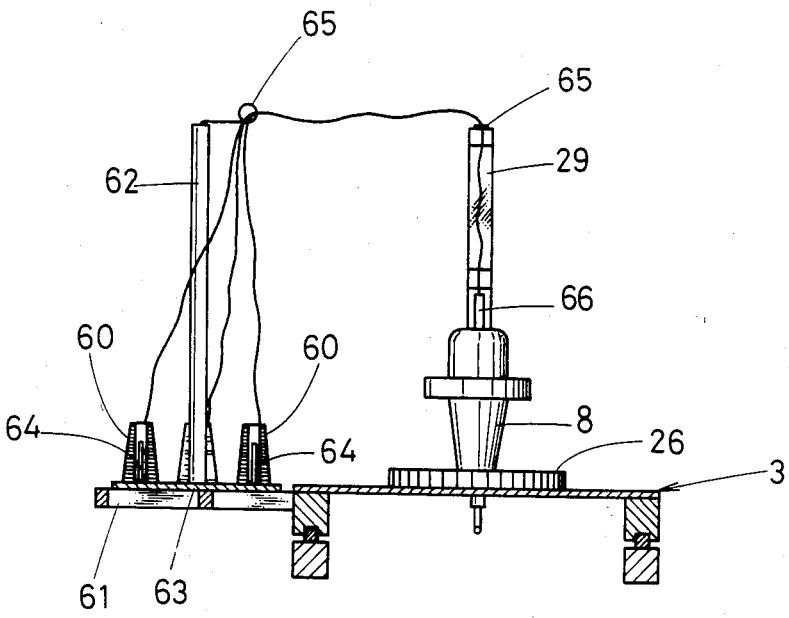
FIG. 16 is a longitudinal section view showing the relation between the second travel platform and a supporting structure.

As illustrated in FIG. 16, a support base 61 for a plurality of cones 60, 60 on which pile yarn B has been wound is disposed alongside said second travel platform 3 in such a manner that the support base 61 and second travel platform 3 are shifted as a unit. Secured to this support base 61 is a support plate 63 which carries a central projecting guide bar 62 and a plurality of shafts 64, 64 disposed around said guide bar 62 for supporting said cones.

The top end of said guide bar 62 and the top end of the post 29 described hereinbefore are respectively fitted with guide rings 65, 65, and the pile yarn B drawn up from said cones 60 . . . is introduced into the hook device 8 via a guide ring 65 of said guide bar 62, a guide ring 65 of said post 29 and a guide cylinder 66 of the hook device 8.

Therefore, according to which of the cones 60 is used or which combination of pile yarns B are used, one may freely change the color, for instance.

In controlling the attitude of the hook device 8 by means of the NC unit to be described hereinafter, the rotary element gear 26 is set so that it may turn only within a range of 185 degrees in either direction from the original attitude. Therefore, it does not happen that the pile yarns drawn out from the cones 60, 60 are entangled between the post 29 and guide bar 62.

Furthermore, since the gear 26 turns within the range of 185 degrees in either direction, the following advantage is assured. Thus, when a pattern to be reproduced is such that the hook device 8 is to be linearly reciprocated, even if there is a variation in the data representing the angle of rotation of said gear 26 that is inputted to the NC unit, the motion of reversal of the hook device 8 at the extremes of the pattern is positive and smooth. Thus, at the extremes of said pattern, the input data may call for a reversal of the hook device 8 slightly beyond the rotation angle of 360 degrees but under the above-mentioned angle setting according to the present invention, a reversal is feasible even under such input conditions.

(4) The NC unit:

The construction of this NC unit is similar to that of the NC devices commonly employed for machine tools. In this embodiment, tapes are used as data memory means and the data necessary for weaving a carpet are recorded on a single tape.

As the above tape is loaded into the tape reader of the NC unit N and the latter unit is switched on, the data read by the tape reader is inputted into a computation unit via an input circuit and the drive output units of the apparatus performs a given operation in accordance with the input signal from the computation unit.

In this embodiment, the output units controlled by the NC unit are the first, second and third pulse motors 20, 23, 25, the first and second air cylinders 33, 51, and the hook device 8, and these component units respectively perform the operations described hereinbefore under the control of the NC unit.

Incidentally, the action of the first air cylinder 33 is set separately for the non-loop construction where the pile yarn B is scissored at each weaving cycle and for the loop construction where the pile yarn B is not scissored.

Figure 17:
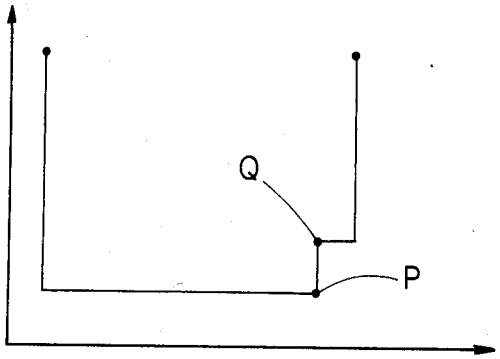
FIG. 17 is a diagrammatic reproduction illustrating the action of the hook device in loop weaving.

In the former construction, the hook device 8 descends by a predetermined stroke prior to the start of travel and, then, after the hook device 8 is driven to weave one section of the pattern, it is lifted. In the latter loop construction, the hook device 8 is operated as shown in FIG. 17. This operation is descibed in detail below. At the time when embroidering of a section of the pattern has been completed, the operation of the hook device 8 is stopped once and as the movable cylinder 43 is brought to a predetermined elevated position completely apart from the substrate cloth A, it is stopped again. During this shift from point P to point Q, the hook device 8 is caused to perform idling for a predetermined number of cycles (the action to feed out the pile yarn B without driving it into the substrate cloth A). At this stop point Q, the hook device 8 is elevated to a predetermined height associated with the spatial relation with the cutting unit 49 and stopped once in this position. At this time point, the second air cylinder 51 is actuated to cut the pile yarn B pendent from the hook device 8 with the scissor unit 53. Thereafter, the hook device 8 is reset to the initial position.

The above sequence of actions overcomes the trouble that would occur if, upon completion of embroidering for one section, the hook device 8 is directly lifted to point Q in FIG. 17 (the position where the pile yarn B is scissored). In other words, one can avoid the trouble of the pile yarn B which has been driven into the substrate cloth A being pulled out by lifting of the hook device.

The whole action of the carpet manufacturing apparatus according to the present invention is as follows.

The hook device 8 is first loaded with pile yarn B suitable for weaving a selected design. At the NC unit N, the data corresponding to the design is inputted from a tape or other memory means. By this reading of the data or by a certain preceding operation, the hook device 8 is brought into contact with a substrate cloth A to be embroidered. Then, in accordance with the data read into the NC unit N, the first and second drive means are actuated to drive the first and second travel platforms in the directions of Y-axis and X-axis, respectively, whereby the hook device 8 is shifted in the composite of the above directions. By this time, the hook device 8 has been started and has also been set to the attitude suited to the direction of travel by the third drive means. Therefore, the hook device 8 travels in the same manner as it is driven by hand and, irrespective of driving along a curve or in a straight pass, the pile yarn B is driven into the substrate cloth A.

One section of the operation region of the hook device 8 is set according to the configuration and color pattern of the design to be reproduced, and the above series of operation is executed for each section and as the hook device 8 travels over all the sections, a product carpet is woven up. Then, the embroidered cloth A is detached from the weaving frame 1 and after-treated in the routine manner to give a finished carpet.

Having the construction described so far, the present invention offers the following various advantages.

(1) The conventional manual operation of driving a pile yarn into the substrate cloth with a hand-held hook machine is automatically performed and, therefore, the manufacturing time is shortened.

Moreover, as the various operational component units of the apparatus are driven in accordance with output signals from an NC unit, carpets with varied and intricate designs which have heretofore been fabricated only manually can now be manufactured by the simple procedure of providing a variety of tapes or other memory means. In other words, a variety of carpets can be manufactured with efficiency.

(2) As the attitude of the hook device is set properly at each time point, it does not happen that the traveling direction of the hook device is in conflict with its attitude. Accordingly, the hook device travels and functions smoothly, so that the incidence of rejects is minimized.

(3) As the pile yarn is cut at the end point of each weaving section, a loop-weave embroidered carpet can be woven up by driving the travel platform continuously for each embroidering section while operating the hook device according to a predetermined timing schedule.

(4) As the amount of deflection of substrate cloth owing to the dead weight of the hook device is small, the offset between the locus of travel of the hook device in a plane including the top surface of the weaving frame and the locus of embroidering action on the substrate cloth is drastically reduced. This means that less skill is required in the operation of the hook device.

(5) As the supporting cords preset over the weaving frame do not interfere with the embroidering action of the hook device, the freedom of design is the same as in the case of manual weaving.

(6) As there is only a reduced amount of deflection that is produced when the hook device is mechanically lowered in accordance with embroidering action, the offset between the locus of travel of the hook device and the reproduced design is minimized.

(7) As the load due to the hook device on the substrate cloth is reduced, there is no trouble of the cloth being stretched during the embroidering operation.

(8) The abutment guide of the apparatus according to the present invention does not pick the pile yarn, the travel of the hook device is smooth so that the efficiency of the embroidering operation is improved.

(9) The above-mentioned incidence of picking the pile yarn is positively prevented even when the traveling direction of the hook machine is altered abruptly while it is kept in driven condition. Therefore, it does not happen that, as it is the case of a loop machine, the abutment guide picks the end of the pile yarn to pull out the yarn once driven into the substrate cloth.

The foregoing description of embodiments are merely intended to illustrate the present invention and should by no means be construed as limiting the scope of the invention. Thus, one skilled in the art may make various changes and modifications without departing from the scope pointed out in the appended claims.

What is claimed is:

1. An apparatus for manufacturing an embroidered carpet comprising a weaving frame (1) for supporting a substrate cloth under tension, said weaving frame having one side designated as X-axis with the adjacent side designated as Y-axis, a first travel platform (2) disposed above said weaving frame (1) and adapted to be driven by a first drive means to travel in the direction of said Y-axis, and a second travel platform (3) movably mounted on said first travel platform and adapted to be driven by a second drive means to travel in the direction of said X-axis, said second travel platform (3) being provided with a rotary element (26) adapted to be driven in normal and reverse directions by a third drive means and having a central aperture (28), a hook device (8) which is mounted on said rotary element in such a manner that it may move up and down through said aperture, said hook device (8) having at its forward end a needling mechanism (32) which is positioned in concentricity with said aperture (28) for access to said substrate cloth (A) lying thereunder, and an NC unit (N) for controlling the actions of said first, second and third drive means and hook device (8), said NC unit (N) being supplied with input signal data corresponding to the amounts of action of said first, second and third drive means at respective time points according to a weaving sequence of a predetermined design.

2. A carpet manufacturing apparatus as claimed in claim 1 wherein a plurality of supporting cords (9) . . . are spread at predetermined pitches across a plane including tops of side members (4) constituting said weaving frame (1).

3. A carpet manufacturing apparatus as claimed in claim 1 wherein said hook device (8) is actuated in a X-Y plane parallel to said substrate cloth (A) spread on said weaving frame (1) and lowered toward the substrate cloth (A) to bring a guide member (42) thereof into contact with said substrate cloth (AS), said hook device (8) being associated with a post (29) of said second travel platform (3) in such a manner that the former is vertically movable therealong, said post (29) being provided with a lifting device adapted to become operable only when said hook device is to be lifted and said post (29) being further provided with a biasing means for imparting an upward biasing force to said hook device (8) when the latter is in a lowered position.

4. A carpet manufacturing apparatus as claimed in claim 1 wherein an abutment guide (42) is provided in contiguity with the body of said hook device (8) at a lower end thereof for maintaining a constant spacing between said hook device (8) and said substrate cloth (A), said abutment guide (42) being formed by smooth curved surfaces and having a central perforation through which a movable cylinder (43) of said hook device (8) reciprocates.

5. A method for manufacturing an embroidered carpet which comprises providing a hook device (8) mounted on travel platforms (2), (3) to travel in planes parallel to a weaving frame (1) supporting a substrate cloth (8) and above said substrate cloth (8), driving said travel platforms (2), (3) for each embroidering section according to a predetermined program, lowering said hook device (8) at the starting point of said each emboroidering section and lifting the same away from the substrate cloth (A) at the end point of said section, providing a cutting unit (49) alonside said hook device on said travel platforms (2), (3), positioning said cutting unit near the top surface of said substrate cloth (A) and outside of the vertical path of the hook device, bringing a scissor unit (53) of said cutting unit into or out of said vertical path of said hook device, cutting a pile yarn (B) with said scissor unit (53) as it enters into said vertical path at a time point when a needling mechanism (32) at a tip of said hook device (8) has been lifted back to a predetermined height with respect to said substrate cloth (A).

6. A method for manufacturing an embroidered carpet as claimed in claim 5 wherein said hook device (8) is caused to perform a predetermined number of idling operations during or prior to a lifting back of the hook device to a position of cutting said pile yarn.

* * * * *